US010539273B1

(12) United States Patent
Cai

(10) Patent No.: US 10,539,273 B1
(45) Date of Patent: Jan. 21, 2020

(54) RECESSED REPLACEABLE LED OFFICE LAMP

(71) Applicant: Yueqi Cai, Ningbo (CN)

(72) Inventor: Yueqi Cai, Ningbo (CN)

( * ) Notice: Subject to any disclaimer, the term of this patent is extended or adjusted under 35 U.S.C. 154(b) by 0 days.

(21) Appl. No.: 16/105,256

(22) Filed: Aug. 20, 2018

(51) Int. Cl.

| | |
|---|---|
| ***F21S 8/00*** | (2006.01) |
| ***F21K 9/275*** | (2016.01) |
| ***F21K 9/272*** | (2016.01) |
| ***F21S 8/02*** | (2006.01) |
| ***F21K 9/68*** | (2016.01) |
| ***F21V 17/18*** | (2006.01) |
| *F21Y 103/10* | (2016.01) |

(52) U.S. Cl.
CPC ..... *F21K 9/275* (2016.08); *F21K 9/272* (2016.08); *F21K 9/68* (2016.08); *F21S 8/026* (2013.01); *F21V 17/18* (2013.01); *F21Y 2103/10* (2016.08)

(58) Field of Classification Search
CPC . F21K 9/272; F21K 9/275; F21K 9/66; F21K 9/68; F21S 8/02; F21S 8/026; F21S 8/04; F21S 8/06; F21S 8/061; F21S 13/02; F21S 8/068; F21V 17/18
See application file for complete search history.

(56) References Cited

U.S. PATENT DOCUMENTS

| | | | | |
|---|---|---|---|---|
| 5,727,871 | A * | 3/1998 | Kotloff | F21V 17/107 362/217.06 |
| 10,190,750 | B1 * | 1/2019 | Clements | F21S 8/026 |
| 2018/0010746 | A1 * | 1/2018 | Li | F21S 8/026 |
| 2018/0231219 | A1 * | 8/2018 | Leung | F21V 7/10 |

* cited by examiner

*Primary Examiner* — Y M. Lee
(74) *Attorney, Agent, or Firm* — Muncy, Geissler, Olds & Lowe, P.C.

(57) ABSTRACT

The present invention discloses a LED retrofit troffer, comprising a lamp housing and a lampshade, wherein, the bottom side of the lamp housing contains a bottom plate extending outwards, and the outer edge of the bottom plate is arranged on the mounting joist; the side edge of the bottom plate is arranged with a hanging plate, which is mounted on the lower side of the bottom plate via a plurality of connecting mechanisms and movably connected with the bottom plate, and a locking mechanism is arranged to lock the position of the hanging plate on the bottom plate. The present invention is convenient for mounting and disassembly, capable of being firmly fixed, and has attractive appearance, with wide acceptance.

10 Claims, 16 Drawing Sheets

RECESSED REPLACEABLE LED OFFICE LAMP

FIELD OF THE INVENTION

The present invention relates to the field of LED lamps, in particular to a recessed replaceable LED office lamp.

BACKGROUND OF THE INVENTION

A LED lamp not only has the advantages of energy saving, environmental friendliness and long service life, but also is capable of realizing wireless control over the color and brightness of the lamp according to different needs. Because of its wide application, it quickly entered the market. However, hospitals, schools, office buildings, etc. where light fixtures are used have employed conventional grille lamps for many years. As a result, it is difficult to conduct LED energy-saving retrofit, and much difficult is involved in dismantling old lamps. In this case, removing the fluorescent tube and cutting off the power cord of the old grille lamp to insert it into a new LED recessed replaceable lamp, without dismantling the old lamp panel, becomes an increasingly popular mode, which is highly accepted by users.

At present, the common retrofit method is adopting split field assembly, or using 2-4 additional mounting edgings to press a replaceable LED lamp or additional edgings between the old grille lamp and the ceiling joist, which realizes the object of quickly replacing different types of general old lamps with different structures. However, such methods, no matter split assembly or additional edgings, have the disadvantages of many installation steps, time-consuming process and huge manpower.

For example, the U.S. Pat. No. 9,206,948B1 provides a system and method for retrofitting an existing troffer style light fixture, comprising a bracket which includes a channel configured to rest on a T-bar of a ceiling system, and further configured to be located between the T-bar and a troffer housing; the bracket further includes a slot configured to receive a portion of a troffer door assembly and a latch surface configured to engage with a latch. Additionally, the kit includes a door assembly which has a latch configured to engage the latch surface of the bracket and a hinge configured to interface with the slot of the adaptor bracket. When the device provided in the invention is mounted on the original ceiling system, all components need to be assembled first. The complicated process affects installation efficiency.

Therefore, those skilled in the art devoted themselves to developing a recessed replaceable lamp with fixed horizontal movement or 90° rotation, without dismantling the old lamp panel, and realized the object of easy installation, firm fixation, attractive appearance and high acceptance.

SUMMARY OF THE INVENTION

Considering the aforesaid shortcomings of the prior art, the technical problem to be solved by the present invention is that the installation of existing replaceable lamps needs preassembly, which consumes much time and energy.

To achieve the aforesaid object, the present invention provides a recessed replaceable LED office lamp, comprising a lamp housing and a lampshade, characterized in that, a LED light source module is arranged in the lower side of the lamp housing, wherein, the lamp housing comprises a top plate and side plates on both sides of the long edge of the top plate; the lampshade is inserted in the lamp housing so as to encircle the LED light source module within the containing space composed of the lamp housing and the lampshade;

Both sides of the wide edge of the top plate are arranged with an end plate respectively, which seals up the openings composed of the top plate and side plates; the bottom side of the lamp housing contains a bottom plate extending outwards, and the bottom plate is respectively connected with the bottom sides of the two side plates and two end plates; the bottom plate extends towards the side plates and end plates, and the outer edge thereof is arranged on the mounting joist at the time of mounting;

At least one of the two side edges of the bottom plate corresponding to the side plate is arranged with a hanging plate, which is mounted on the lower side of the bottom plate via a plurality of connecting mechanisms and movably connected with the bottom plate; the hanging plate is capable of horizontally sliding towards the outer side of the bottom plate by coordinating with the connecting mechanisms, and a locking mechanism is arranged to lock the position of the hanging plate on the bottom plate after horizontal sliding.

Furthermore, the connecting mechanisms comprise sliding fasteners on the hanging plate, and the edge of the bottom plate is arranged with a sliding slot; the sliding fasteners are fixedly connected with the hanging plate and vertically thread through the sliding slot; the top of each sliding fastener is fastened to the upper end face of the bottom plate after being bent.

Furthermore, one side of the hanging plate facing towards the lamp housing is bent or welded into a convex rib, which protrudes downwards.

In one embodiment of the present invention, the edge of the bottom plate is arranged with a vertical wall, which is arranged with a side slot that is parallel to the direction of the sliding slot on the bottom plate in the middle of the side end of the hanging plate; a locking slot from the upper end to the middle of the vertical wall is arranged adjoining the side slot; the side edge of the hanging plate is fixedly connected with a latch, and a rotating shaft is arranged in the middle of the latch; the rotating shaft is embedded in the side slot and capable of sliding along the side slot; the latch head is bent into a hook which is capable of being clipped in the locking slot of the vertical wall after being rotated with a handle so as to realize locking between the hanging plate and the bottom plate. Furthermore, the latch tail comprises a handle extending downwards laterally; the latch rotates along the rotating shaft by use of the handle; when the hook is fixed in the locking slot of the vertical wall, the handle clings to the bottom of the bottom plate.

In another embodiment of the present invention, ball-catches are arranged on both side ends of the bottom plate, or on the side edges of the front face of the bottom plate, or in the middle of the front face of the bottom plate; the end of the ball-catch is arranged with a press-type spring bead or spring cylinder, which threads through the bottom plate; the center or edge of the hanging plate is arranged with a keyhole corresponding to the spring bead or spring cylinder; during the horizontal movement of the hanging plate, the spring bead or spring cylinder is buckled into the keyhole to realize locking or release between the hanging plate and the bottom plate.

In another embodiment of the present invention, the connecting mechanisms comprise spring pins arranged along the horizontal movement direction of the hanging plate; both ends of each spring pin are respectively fixed on the side edges of the bottom plate and the hanging plate; a compression spring is arranged between the side edges of the bottom plate and the hanging plate; when the compression spring is in the compressed state, the fixing pin fixes the bottom plate and the hanging plate from the bottom of the hanging plate; when the fixing pin is removed, the compression spring recovers and elongates, locking the position of the hanging plate relative to the bottom plate.

In another embodiment of the present invention, the connecting mechanisms comprise rotating fasteners on the back of the hanging plate; the bottom side of the bottom plate is arranged with a sliding slot; the rotating fastener is connected with the back side of the hanging plate by a screw which moves along the sliding slot; the rotating fastener is connected to the screw end in a rotatable way; the bottom of the rotating fastener is arranged with an end cap fitting the size of the sliding slot, and the end cap is capable of being embedded in the sliding slot by a 180° rotation clockwise or counterclockwise to realize locking between the hanging plate and the bottom plate.

Furthermore, it is characterized in that a reflector is arranged in the lower side of the side plate and the top plate of the lamp housing.

Furthermore, a LED driver mounting rack is arranged in the upper side of the side plate of the lamp housing.

Furthermore, hanging holes are arranged at both ends of the top of each end plate.

The recessed lamp provided in the present invention is easy to use, convenient for mounting and disassembly, capable of quickly completing the mounting work with no need of assembling components with the help of the structures of the old lamp panel like the joist, and has the advantages of firm fixation after mounting and attractive appearance, with wide acceptance.

The conception, specific structure and technical effect of the present invention will be further illustrated by reference to the accompanying drawings so as to have a full understanding of the object, characteristics and effect of the present invention.

Wherein, 10 lamp housing, 11 lampshade, 12 top plate, 13 side plate, 14 LED driver mounting rack, 15 end plate, 16 hanging hole, 20 bottom plate, 21 sliding slot, 22 end fastener, 23 side slot, 25 locking slot, 30 hanging plate, 31 sliding fastener, 32 convex rib, 33 auxiliary plate, 34 keyhole, 35 rotating fastener, 36 end cap, 40 latch, 41 rotating shaft, 42 hook, 43 handle, 50 ball-catch, 51 cylinder, 52 bead, 60 spring spin, 61 compression spring, 62 fixing spin, 71 joist, 72 steel wire.

DETAILED DESCRIPTION OF THE PREFERRED EMBODIMENTS

Embodiment 1

Figure 1:
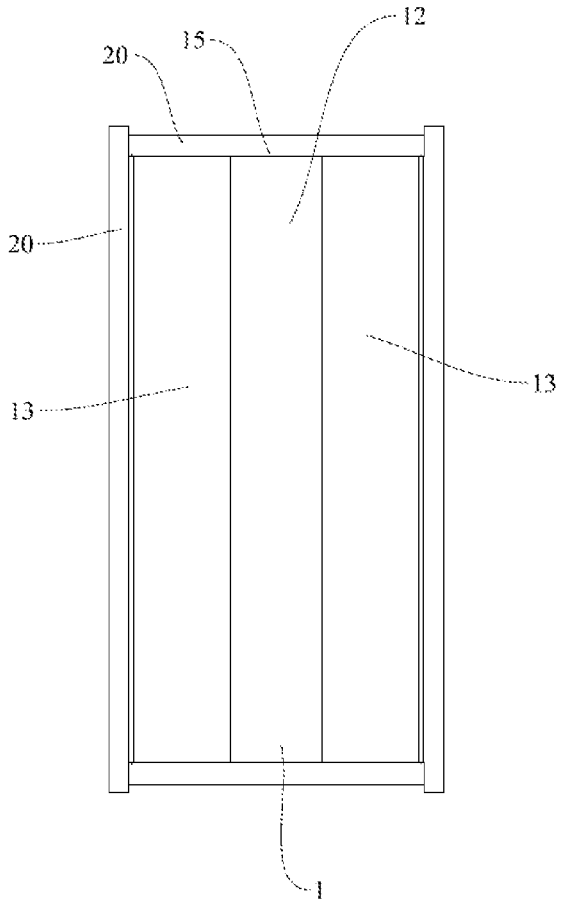
FIG. 1 is a top view of Embodiment 1 of the recessed replaceable LED office lamp in the present invention.
Figure 2:
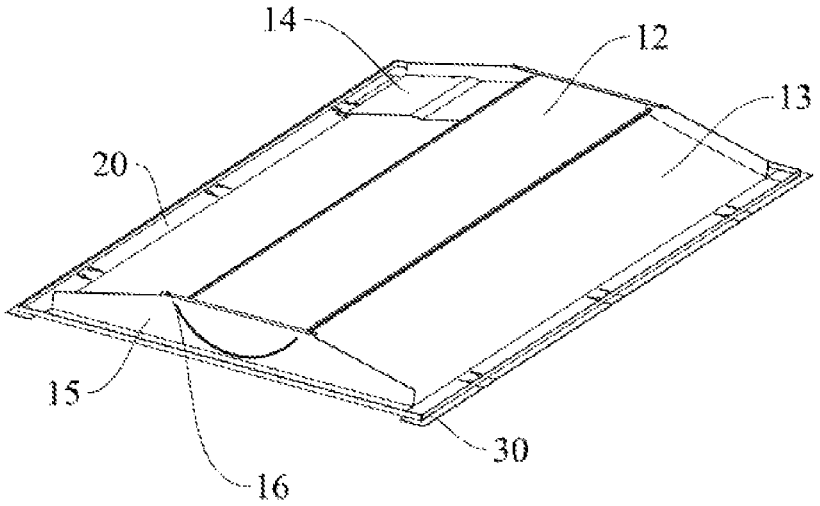
FIG. 2 is a structure view of the recessed replaceable LED office lamp in Embodiment 1 of the present invention.

FIGS. 1 and 2 illustrate a recessed replaceable LED office lamp provided in the present invention, comprising lamp housing 10 and lampshade 11, wherein, the LED light source module is arranged in the lower side of lamp housing 10 which comprises top plate 12 and side plates 13 on both sides of the long edge of top plate 12; LED driver mounting rack 14 is arranged in the upper side of side plate 13, and a LED driver is fixedly mounted therein; lampshade 11 is inserted in lamp housing 10 to encircle the LED light source module within the containing space composed of lamp housing 10 and lampshade 11; a reflector is arranged in the lower side of side plate 13 and top plate 12. Both sides of the wide edge of top plate 12 are arranged with an end plate 15 respectively, which seals up the openings composed of top plate 12 and side plates 13; end plate 15 is arranged with a wire through-hole, and the wire of the LED light source module threads through the through-hole on end plate 15 to be connected with the LED driver. The bottom side of lamp housing 10 contains a bottom plate 20 extending outwards, which is respectively connected with the bottom sides of two side plates 13 and two end plates 15; bottom plate 20 extends towards side plates 13 and end plates 15, and the outer edge thereof is arranged on mounting joist 71 at the time of mounting. At least one of the two side edges of bottom plate 20 corresponding to side plate 13 is arranged with a hanging plate 30, which is mounted on the lower side of bottom plate 20 via a plurality of connecting mechanisms and movably connected with bottom plate 20; hanging plate 30 is capable of horizontally sliding towards the outer side of bottom plate 20 by coordinating with the connecting mechanisms, enabling hanging plate 30 to move elastically relative to lamp housing 10 and bottom plate 20.

Figure 3:
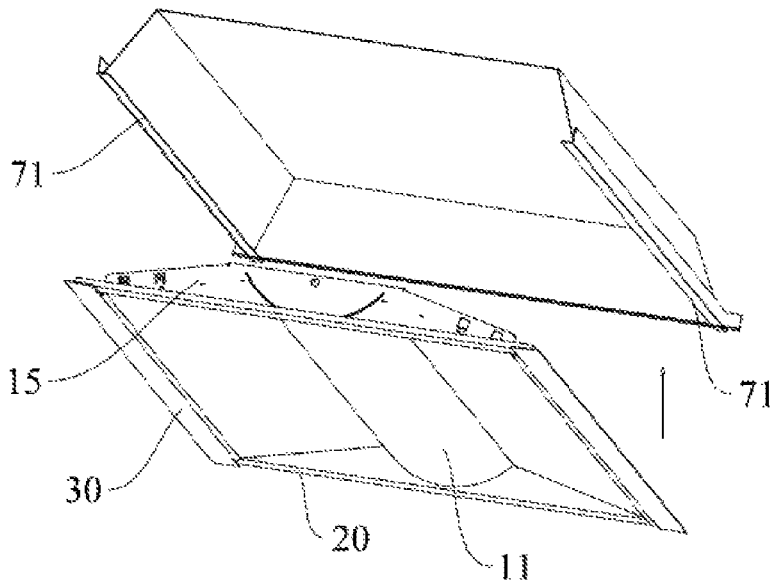
FIG. 3 is the installation view (I) of the recessed replaceable LED office lamp in the present invention.
Figure 4:
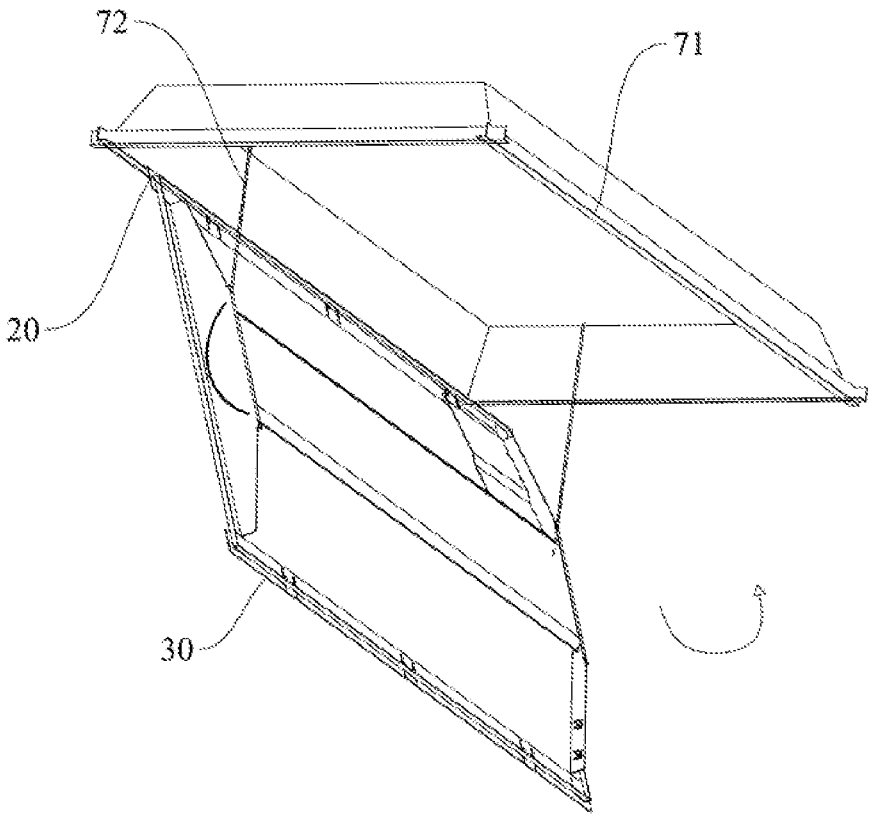
FIG. 4 is the installation view (II) of the recessed replaceable LED office lamp in the present invention.
Figure 5:
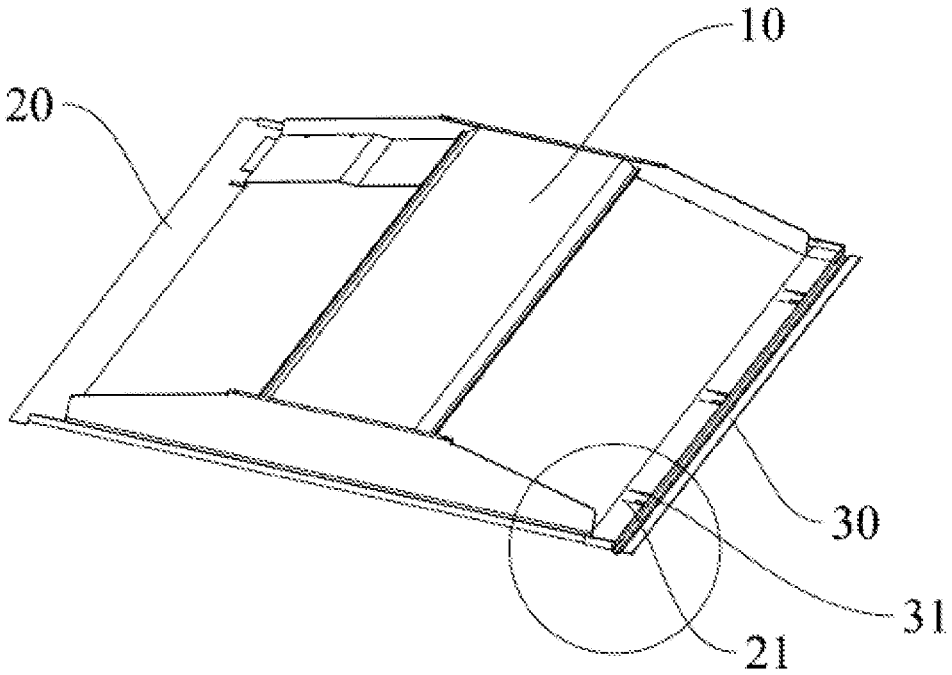
FIG. 5 is a structure view of the recessed replaceable LED office lamp in Embodiment 2 of the present invention.

FIGS. 3 and 4 are the views of the recessed replaceable LED office lamp mounted on the outer edge of the old grille lamp frame in the present invention. Hanging holes 16 are arranged on both ends of the tops of end plates 15. Joist 71 is arranged along the bottom of the lamp frame; hanging holes 16 of end plates 15 are connected with steel wire 72, the other end of which is connected to the bottom of the lamp frame to fixedly hang LED lamp housing 10. One side of bottom plate is feasibly arranged with hanging plate 30 or not, because it partially protrudes from the housing. It is feasible to clamp this side on joist 71 in advance, and connect the connection terminal of the original lamp to the LED driver; then turn over lamp housing 10 from vertical to horizontal. According to the setting, a small spacing exists between the other side of bottom plate 20 of lamp housing 10 and joist 71, and the bottom thereof is connected with hanging plate 30, which horizontally slides outwards until resting on joist 71; then the locking mechanism is used to lock the position of hanging plate 30, thereby achieving the process of mounting the LED office lamp disclosed by the present invention in the old lamp frame. Additionally, in the process of mounting the LED office lamp disclosed by the present invention on the ceiling, we only need to prepare ceiling joist 71, then begin mounting according to the aforesaid process. When disassembly is needed, it is feasible to horizontally move the hanging plate 30 back to generate spacing between the side edge of bottom plate 20 and joist 71. In this way, the hanging plate can be taken down.

Regarding the LED office lamp described in the present invention, its connecting mechanisms and locking mechanism are possibly combined by a plurality of technological means according to actual needs so as to provide installation convenience. Next, the horizontal movement modes of hanging plate 30 of the replaceable LED office lamp in the present invention are expounded with reference to a plurality of embodiments.

Embodiment 2

FIGS. 5-8 illustrate one embodiment of the recessed replaceable LED office lamp described in the present invention. Lamp housing 10 comprises top plate 12 and side plates 13 on both sides of the long edge of top plate 12; LED driver mounting rack 14 is arranged in the upper side of side plate 13, and a LED driver is fixedly mounted therein; lampshade 11 is inserted in lamp housing 10 to encircle the LED light source module within the containing space composed of lamp housing 10 and lampshade 11; a reflector is arranged in the lower side of side plate 13 and top plate 12. Both sides of the wide edge of top plate 12 are arranged with an end plate 15 respectively, which seals up the openings composed of top plate 12 and side plates 13. The bottom side of lamp housing 10 contains a bottom plate 20 extending outwards, which is respectively connected with the bottom sides of two side plates 13 and two end plates 15; bottom plate 20 extends towards side plates 13 and end plates 15, and the outer edge thereof is arranged on mounting joist 71 at the time of mounting.

At least one of the two side edges of bottom plate 20 corresponding to side plate 13 is arranged with a hanging plate 30, which is mounted on the lower side of bottom plate 20; hanging plate 30 is arranged with a plurality of sliding fasteners 31 in pairs; correspondingly, bottom plate 20 is arranged with sliding slots 21 in pairs adjoining the outer side, and the openings of sliding slots 21 are arranged at the side ends of bottom plate 20; sliding slots 21 extend outwards; sliding fasteners 31 are fixedly connected with the upper end face of hanging plate 30, and vertically thread through sliding slots 21; the top of each sliding fastener 31 is hooked to the upper end face of bottom plate 20 after being bent. The coordination between sliding fasteners 31 and sliding slots 21 enables hanging plate 30 connected therewith to horizontally slide towards the outer side of bottom plate 20.

Figure 6:
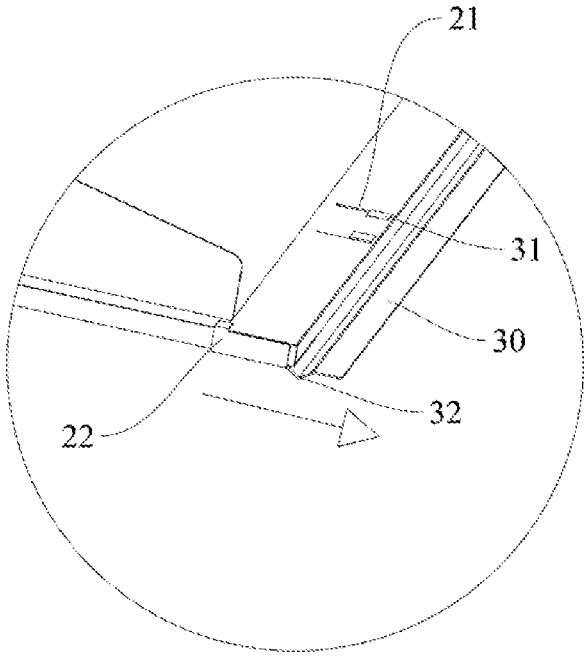
FIG. 6 is a partial structure view of FIG. 5.
Figure 7:
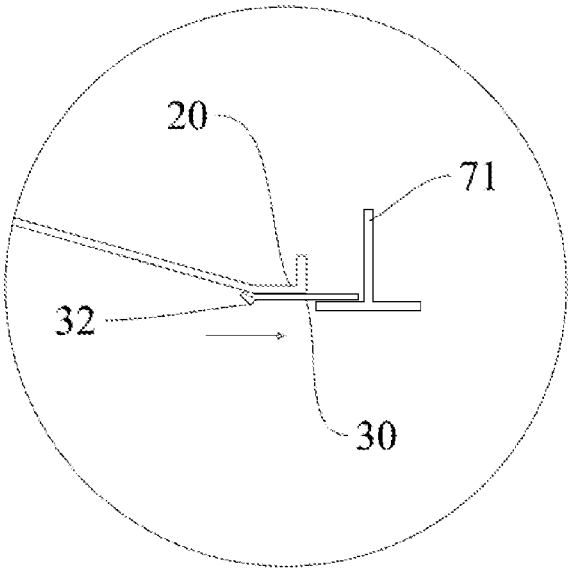
FIG. 7 is a profile view of FIG. 5.
Figure 8:
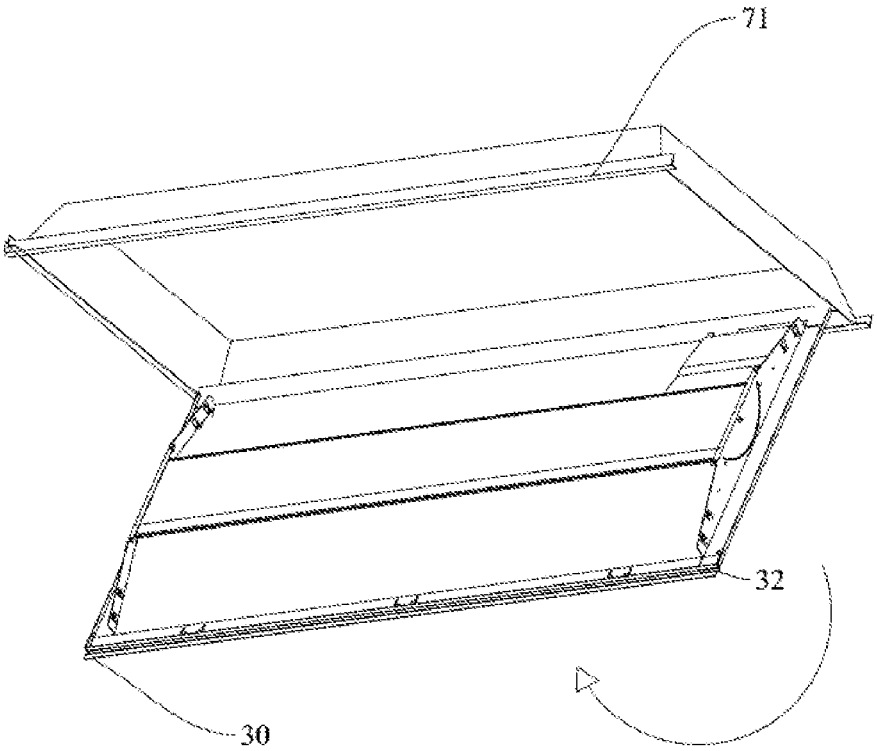
FIG. 8 is an installation view of FIG. 5.

As shown in FIGS. 5-8, one side of hanging plate 30 facing towards lamp housing 10 is the near end below that is close to the inner side of hanging plate 30. This side is bent or welded into convex rib 32, which protrudes downwards. When hanging plate 30 stretches out or draws back, convex rib 32 is capable of assisting hanging plate 30 in horizontal sliding. As shown in FIG. 8, one side of bottom plate 20 is feasibly arranged with hanging plate 30 or not. In the mounting process, it is feasible to first clamp this side on joist 71, and turn over the other side after wiring to enable hanging plate 30 to arrive on joist 71; then push hanging plate 30 outwards along convex rib 32. The coordination between sliding fasteners 31 and sliding slots 21 enables hanging plate 30 to horizontally move in a fixed direction until resting on joist 71. As shown in FIG. 6, end fasteners 22 are arranged on both sides of hanging plate 30, and sleeved on the side faces of bottom plate 20 and hanging plate 30. After reaching the given position, hanging plate 30 is locked on bottom plate 20 through end fasteners 22.

Embodiment 3

FIGS. 9-14 illustrate another embodiment of the recessed replaceable LED office lamp in the present invention. Lamp housing 10 comprises top plate 12 and side plates 13 on both sides of the long edge of top plate 12; LED driver mounting rack 14 is arranged in the upper side of side plate 13, and a LED driver is fixedly mounted therein; lampshade 11 is inserted in lamp housing 10 to encircle the LED light source module within the containing space composed of lamp housing 10 and lampshade 11; a reflector is arranged in the lower side of side plate 13 and top plate 12. Both sides of the wide edge of top plate 12 are arranged with an end plate 15 respectively, which seals up the openings composed of top plate 12 and side plates 13. The bottom side of lamp housing 10 contains a bottom plate 20 extending outwards, which is respectively connected with the bottom sides of two side plates 13 and two end plates 15; bottom plate 20 extends towards side plates 13 and end plates 15, and the outer edge thereof is arranged on mounting joist 71 at the time of mounting.

Figure 9:
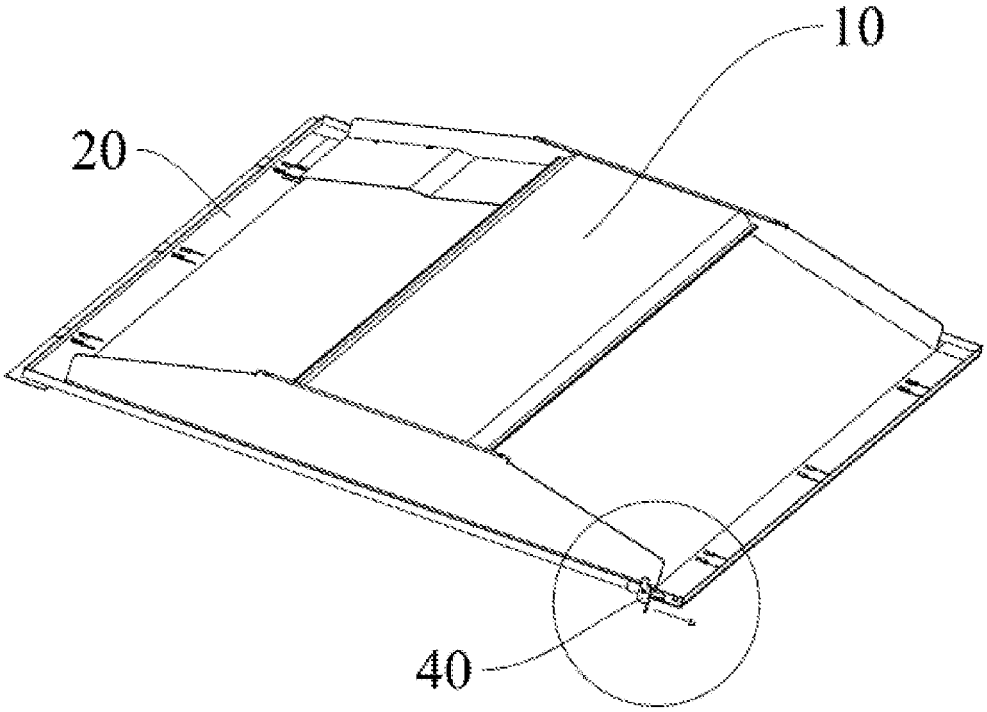
FIG. 9 is a structure view of the recessed replaceable LED office lamp in Embodiment 3 of the present invention.
Figure 10:
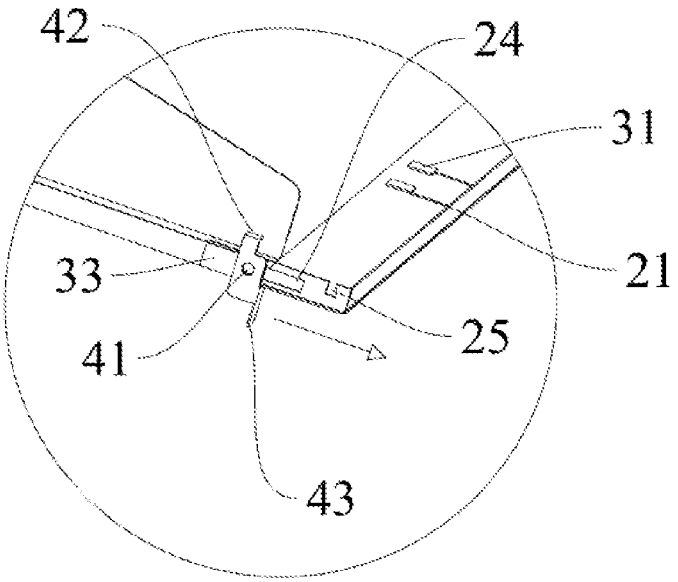
FIG. 10 is a partial enlargement view of FIG. 9 (outward rotation state of the handle).
Figure 11:
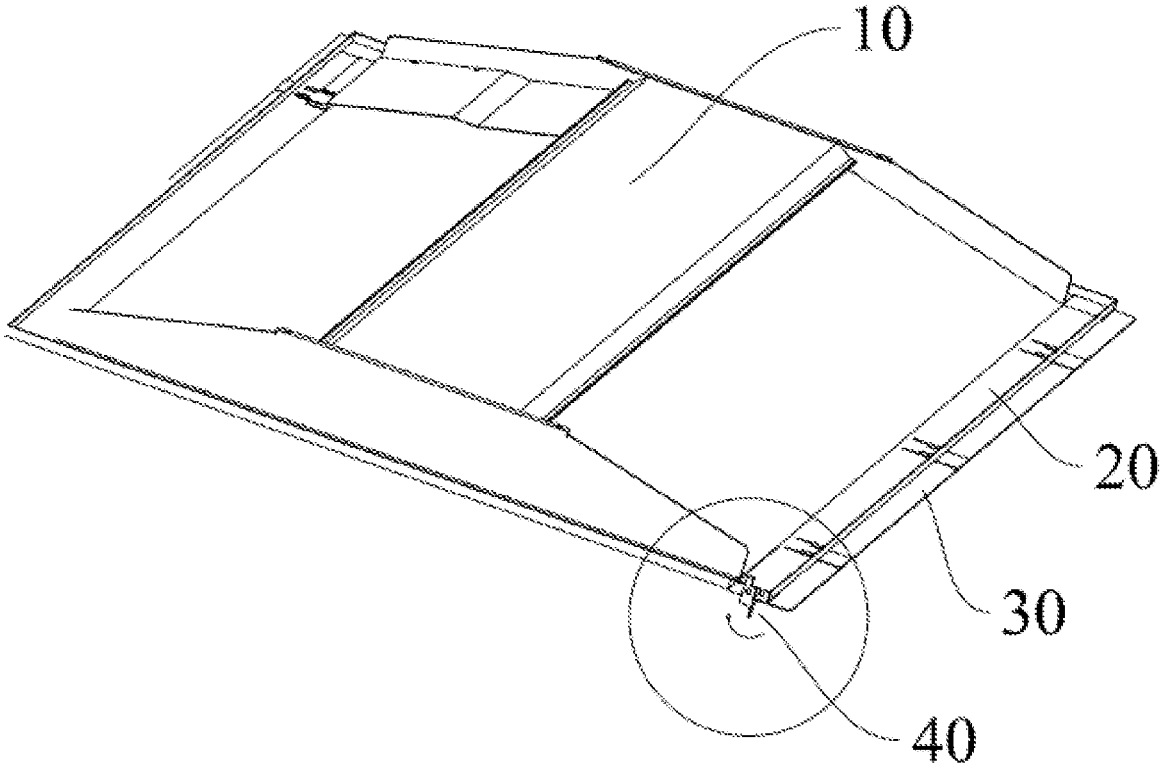
FIG. 11 is a view of handle rotation before locking in the embodiment of FIG. 9.
Figure 12:
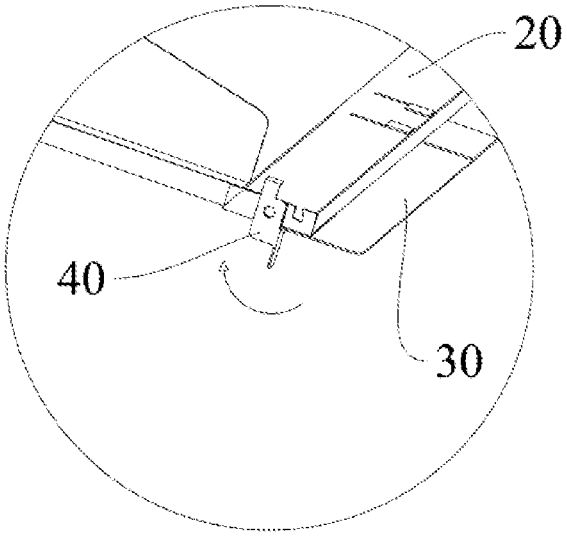
FIG. 12 is a partial enlargement view of FIG. 11 (inward rotation state of the handle).
Figure 13:
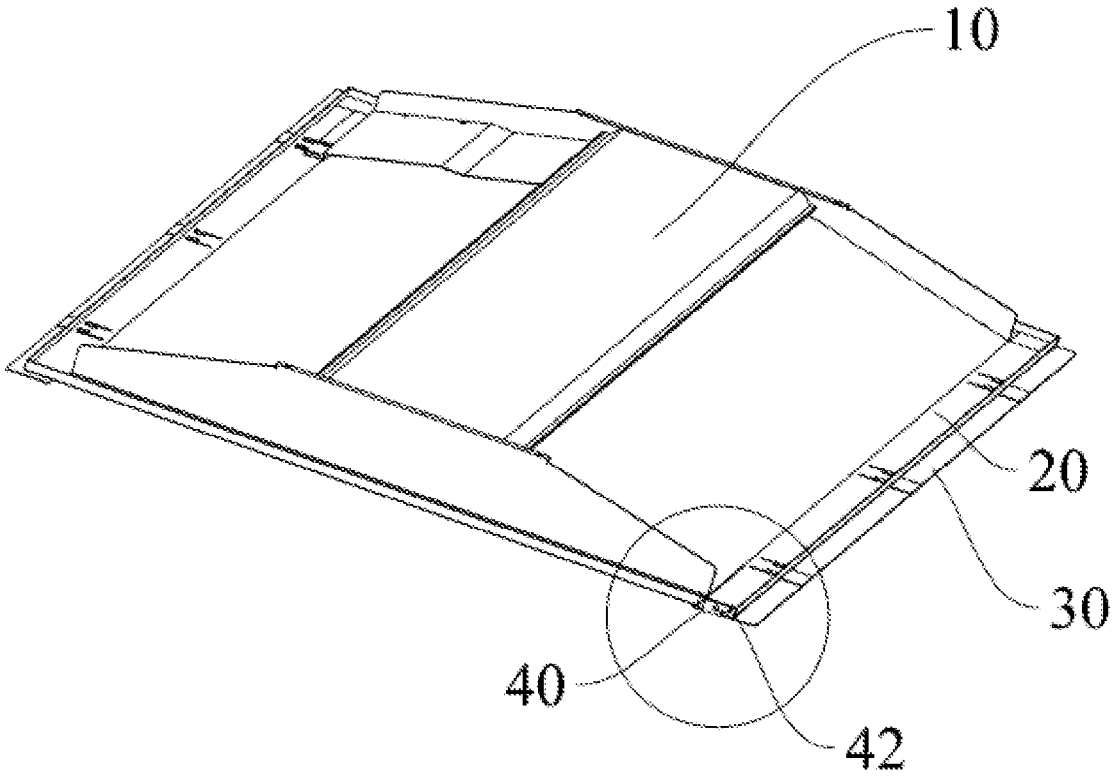
FIG. 13 is a post-locking view in the embodiment of FIG. 9.
Figure 14:
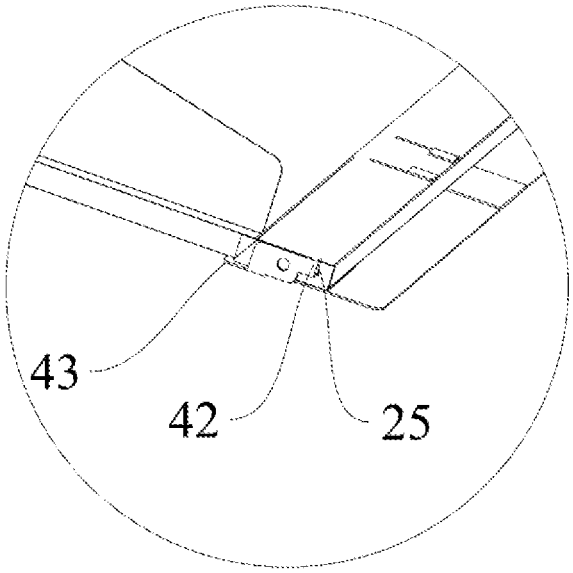
FIG. 14 a partial enlargement view of FIG. 13 (locked state of the latch).

At least one of the two side edges of bottom plate 20 corresponding to side plate 13 is arranged with a hanging plate 30, which is mounted on the lower side of bottom plate 20; hanging plate 30 is arranged with a plurality of sliding fasteners 31 in pairs; correspondingly, bottom plate 20 is arranged with sliding slots 21 in pairs adjoining the outer side, and the openings of sliding slots 21 are arranged at the side ends of bottom plate 20; sliding slots 21 extend outwards; sliding fasteners 31 are fixedly connected with the upper end face of hanging plate 30, and vertically thread through sliding slots 21; the top of each sliding fastener 31 is hooked to the upper end face of bottom plate 20 after being bent. The coordination between sliding fasteners 31 and sliding slots 21 enables hanging plate 30 connected therewith to horizontally slide towards the outer side of bottom plate 20. In the embodiment, the edge of bottom plate 20 is upturned to form vertical wall 23, which is arranged with side slot 24 parallel to the sliding slot 21 on bottom plate 20 along the mid-height position of vertical wall 23 corresponding to two side ends of hanging plate 30; besides, a locking slot 25 from the upper end to the middle of vertical wall 23 is arranged adjoining side slot 24. The side edge of hanging plate 30 is arranged with a latch 40, and an auxiliary plate 33 exists between latch 40 and hanging plate 30 to enable latch 40 to be movably connected to hanging plate 30 and capable of synchronous movement. Latch 40 is arranged with rotating shaft 41 in the middle, which threads through auxiliary plate 33 to be embedded in side slot 24, and is capable of sliding along the side slot 24. The head of latch 40 is bent into hook 42, which is capable of being clipped in locking slot 25 of vertical wall 23 after being rotated with a handle so as to realize locking between hanging plate 30 and bottom plate 20. The tail of latch 40 comprises a handle 43 extending downwards laterally, which is a sheet perpendicular to the plane where latch 40 is located. As the plane where handle 43 is located faces downwards and outwards, when handle 43 rotates outwards in the counterclockwise direction, its upper end against the bottom end of hanging plate causes the rotation of latch 40 to get stuck; in the meantime, the force is decomposed into an outward thrust along hanging plate 30, enabling hanging plate 30 to horizontally move outwards (as shown in FIGS. 9 and 10). When handle 43 rotates inwards in a clockwise direction, it enables latch 40 to rotate clockwise along rotating shaft 41 (as shown in FIGS. 11 and 12). After being turned over, hook 42 is clamped and locked in locking slot 25 on vertical wall 23; the plane where handle 43 is located exactly clings to the bottom of bottom plate 20 (as shown in FIGS. 13 and 14).

Preferably, to enable hanging plate 30 to achieve steady horizontal movement, latch 40, as well as side slots 24 and locking slot 25 are symmetrically arranged on vertical walls 23 on both sides of hanging plate 30.

The position of locking slot 25 is preset as needed. For example, the distance between locking slot and the lateral end of side slot 24 in the direction of horizontal movement is optionally set in line with that between rotating shaft 41 and hook 42. In this way, when latch 40 drives hanging plate 30 to move to an extreme position, hook 42 of latch 40 is capable of being locked exactly in locking slot 25.

In the mounting process, it is advisable to clamp the fixed end of one side of bottom plate 20 on joist 71, and turn over the other side after wiring to enable hanging plate 30 to rest on joist 71; then push the handle outwards. Through the coordination between sliding fasteners 31 and sliding slots 21, and between rotating shaft 41 and side slot 24, hanging plate 30 horizontally moves in a fixed direction until resting on joist 71. Afterwards, it is feasible to rotate the handle inwards in a clockwise direction, enabling latch 40 to be clamped and locked in locking slot 25.

Embodiment 4

FIGS. 15-18 illustrate another embodiment of the recessed replaceable LED office lamp in the present invention. In the embodiment, lamp housing 10 comprises top plate 12 and side plates 13 on both sides of the long edge of top plate 12; LED driver mounting rack 14 is arranged in the upper side of side plate 13, and a LED driver is fixedly mounted therein; lampshade 11 is inserted in lamp housing 10 to encircle the LED light source module within the containing space composed of lamp housing 10 and lampshade 11; a reflector is arranged in the lower side of side plate 13 and top plate 12. Both sides of the wide edge of top plate 12 are arranged with an end plate 15 respectively, which seals up the openings composed of top plate 12 and side plates 13. The bottom side of lamp housing 10 contains a bottom plate 20 extending outwards, which is respectively connected with the bottom sides of two side plates 13 and two end plates 15; bottom plate 20 extends towards side plates 13 and end plates 15, and the outer edge thereof is arranged on mounting joist 71 at the time of mounting.

At least one of the two side edges of bottom plate 20 corresponding to side plate 13 is arranged with a hanging plate 30, which is mounted on the lower side of bottom plate 20; hanging plate 30 is arranged with a plurality of sliding fasteners 31 in pairs; correspondingly, bottom plate 20 is arranged with sliding slots 21 in pairs adjoining the outer side, and the openings of sliding slots 21 are arranged at the side ends of bottom plate 20; sliding slots 21 extend outwards; sliding fasteners 31 are fixedly connected with the upper end face of hanging plate 30, and vertically thread through sliding slots 21; the top of each sliding fastener 31 is hooked to the upper end face of bottom plate 20 after being bent. The coordination between sliding fasteners 31 and sliding slots 21 enables hanging plate 30 connected therewith to horizontally slide towards the outer side of bottom plate 20.

Figure 15:
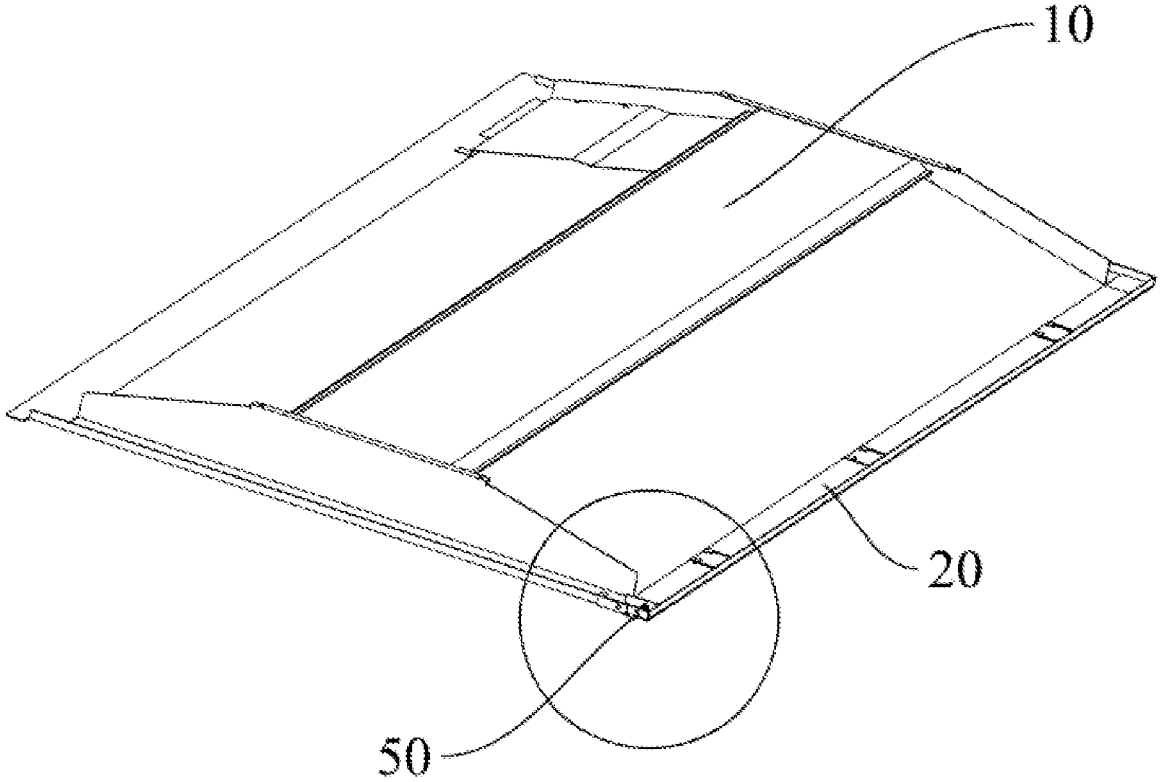
FIG. 15 is a structure view of unlocked state of the recessed replaceable LED office lamp in Embodiment 4 of the present invention.
Figure 16:
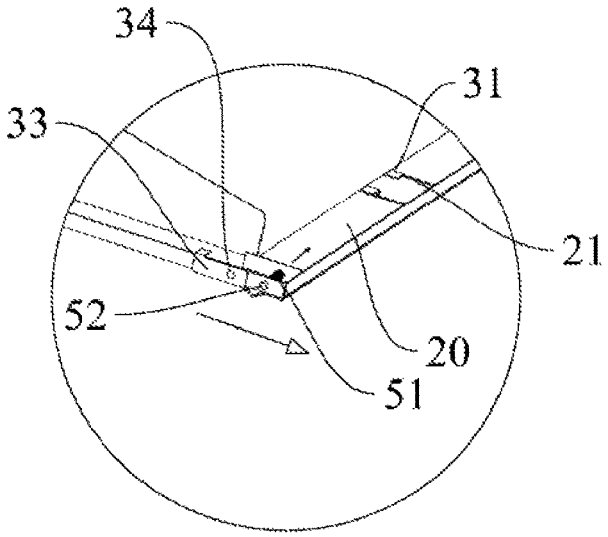
FIG. 16 is a partial enlargement view of FIG. 15.

Ball-catches 50 are arranged on both side ends of bottom plate 20, or on the side edges of the front face thereof, or in the middle of the front face thereof. As shown in FIGS. 15 and 16, ball-catches 50 are arranged at both side ends of bottom plate 20, and the end of each ball-catch 50 is arranged with a press-type spring bead or spring cylinder, which achieves automatic reset under the elastic action after being pressed. As shown in FIG. 16, the cylinder 51 of ball-catch 50 transversely and fixedly threads through bottom plate 20; the bead 52 at the end of ball-catch 50 faces towards the side end of bottom plate 20; auxiliary plates 33 are fixedly arranged in the two sides of hanging plate 30; a keyhole 34 is arranged corresponding to bead 52 in height at the center of each auxiliary plate 33. For example, ball-catches are located in the middle of bottom plate, and the keyhole is correspondingly arranged in the middle of hanging plate. During the horizontal movement of hanging plate 30, bead 52 is buckled into keyhole 34 to realize locking between hanging plate 30 and bottom plate 20. By further pressing or under the shear action between plates, bead 52 retracts and separates itself from keyhole 34 to release the locking. One side of hanging plate 30 facing towards lamp housing 10 is the near end below that is close to the inner side of hanging plate 30. This side is bent or welded into convex rib 32, which protrudes downwards. Convex rib 32 is capable of assisting hanging plate 30 in horizontal sliding elastically.

Figure 17:
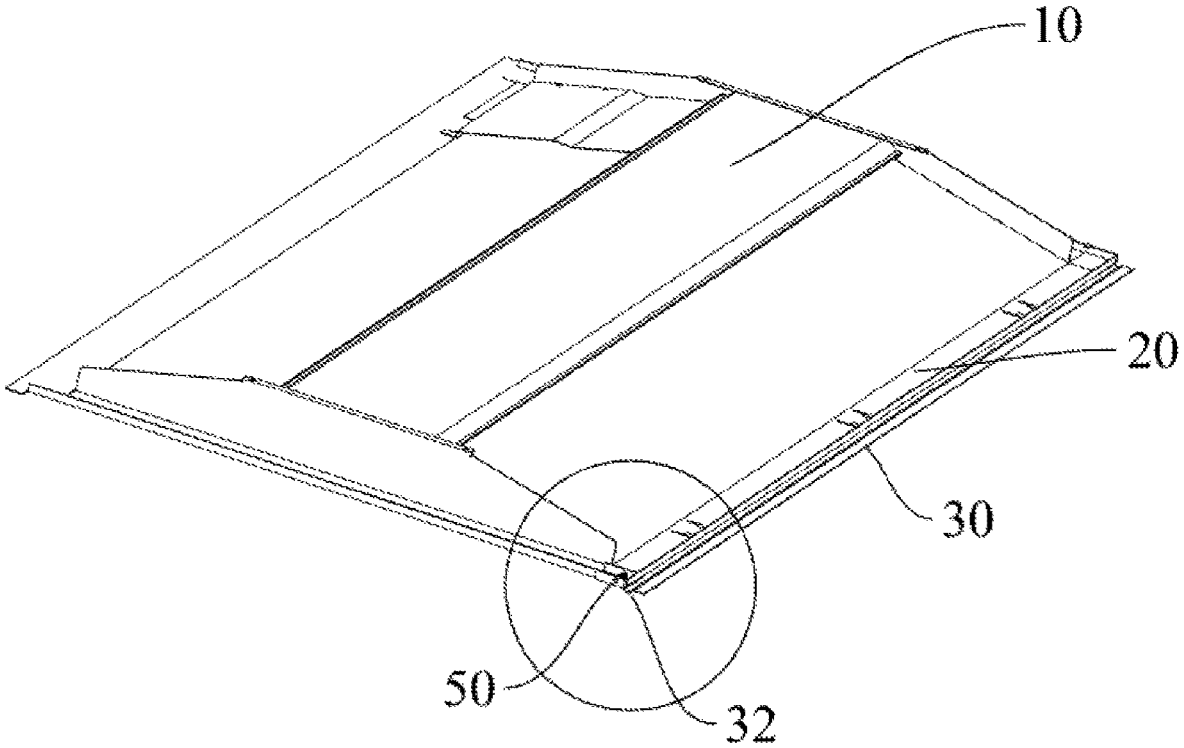
FIG. 17 is a structure view of locked state in Embodiment 4.
Figure 18:
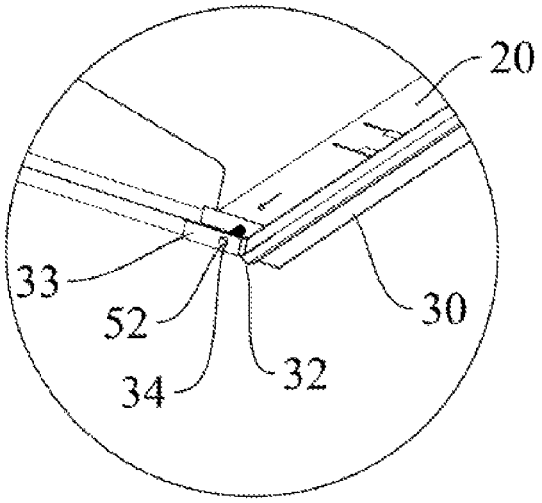
FIG. 18 is a partial enlargement view of FIG. 17.

Before horizontal movement and locking of hanging plate 30, the relative positions of side plate 13 and bead 52 of ball-catch 50 are shown in FIGS. 15 and 16. In the mounting process, it is advisable to clamp the fixed end of one side of bottom plate 20 on joist 71, and turn over the other side after wiring to enable hanging plate 30 to rest on joist 71; then push hanging plate 30 outwards with the help of convex rib 32. During the horizontal movement of hanging plate 30, keyholes 34 on the auxiliary plates 33 on both sides of hanging plate 30 are buckled in via beads 52 of ball-catches 50; beads 52 automatically pop up to keyholes 34 under the elastic action to lock the position and complete the mounting work, as shown in FIGS. 17 and 18. In case that hanging plate 30 needs to be withdrawn, it is feasible to press down bead 52 to unlock and push hanging plate 30 inwards.

Embodiment 5

FIGS. 19-26 illustrate another embodiment of the recessed replaceable LED office lamp in the present invention. Lamp housing 10 comprises top plate 12 and side plates 13 on both sides of the long edge of top plate 12; LED driver mounting rack 14 is arranged in the upper side of side plate 13, and a LED driver is fixedly mounted therein; lampshade 11 is inserted in lamp housing 10 to encircle the LED light source module within the containing space composed of lamp housing 10 and lampshade 11; a reflector is arranged in the lower side of side plate 13 and top plate 12. Both sides of the wide edge of top plate 12 are arranged with an end plate 15 respectively, which seals up the openings composed of top plate 12 and side plates 13. The bottom side of lamp housing 10 contains a bottom plate 20 extending outwards, which is respectively connected with the bottom sides of two side plates 13 and two end plates 15; bottom plate 20 extends towards side plates 13 and end plates 15, and the outer edge thereof is arranged on mounting joist 71 at the time of mounting.

Figure 19:
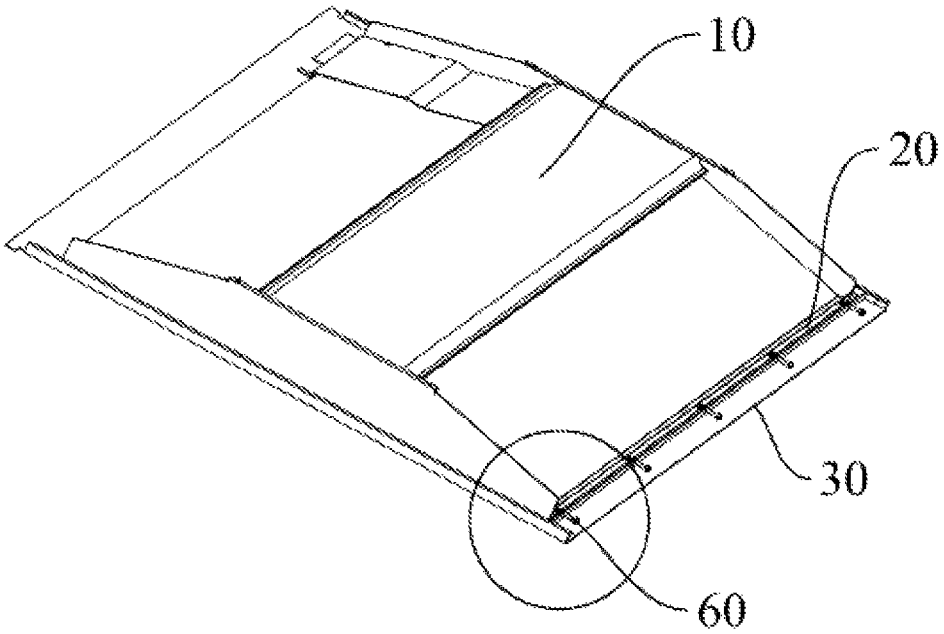
FIG. 19 is a front structure view of the recessed replaceable LED office lamp in Embodiment 5 of the present invention (pin fixing state).
Figure 20:
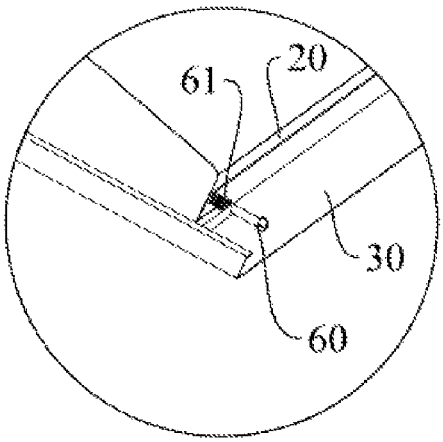
FIG. 20 is a partial enlargement view of FIG. 19.
Figure 21:
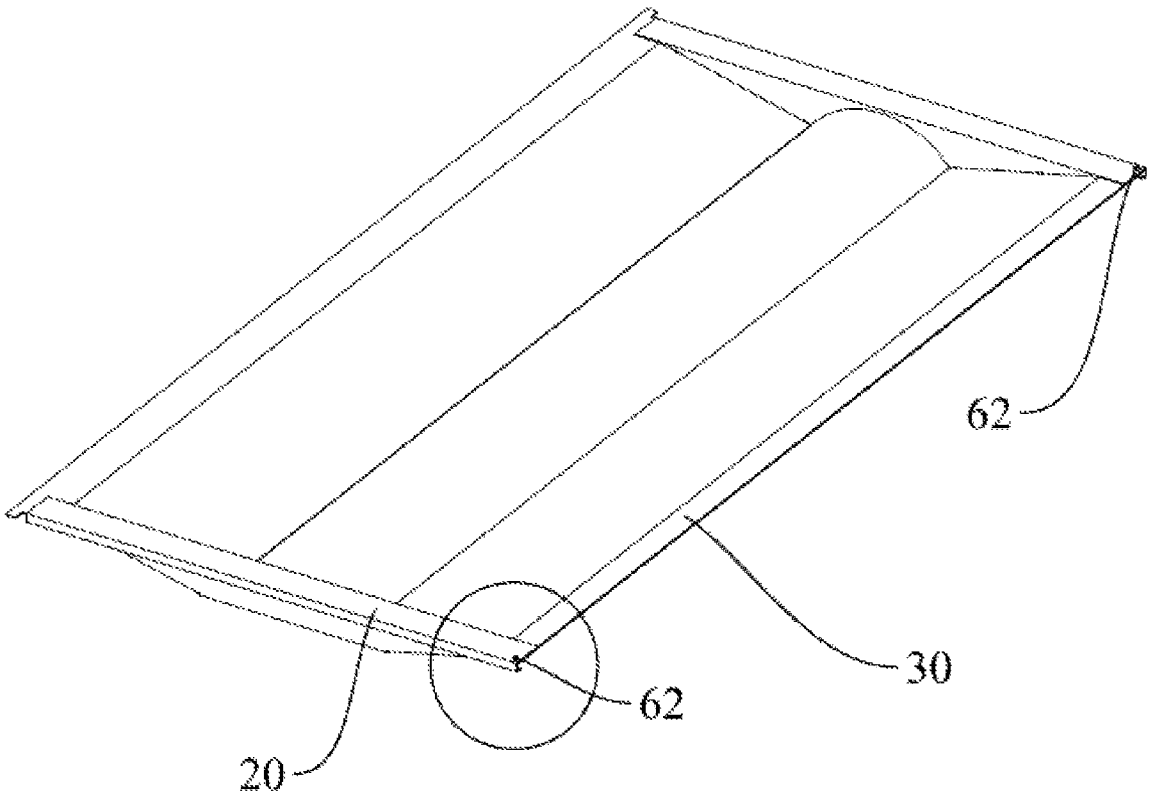
FIG. 21 is a rear view of the recessed replaceable LED office lamp in Embodiment 5 (pin fixing state).
Figure 22:
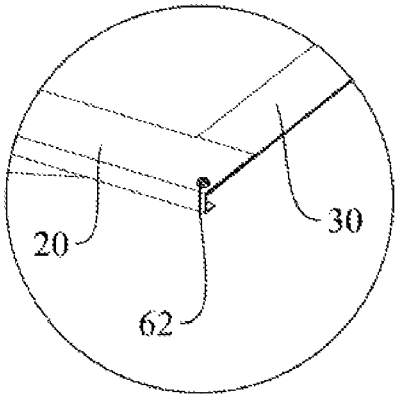
FIG. 22 is a partial enlargement view of FIG. 21.
Figure 23:
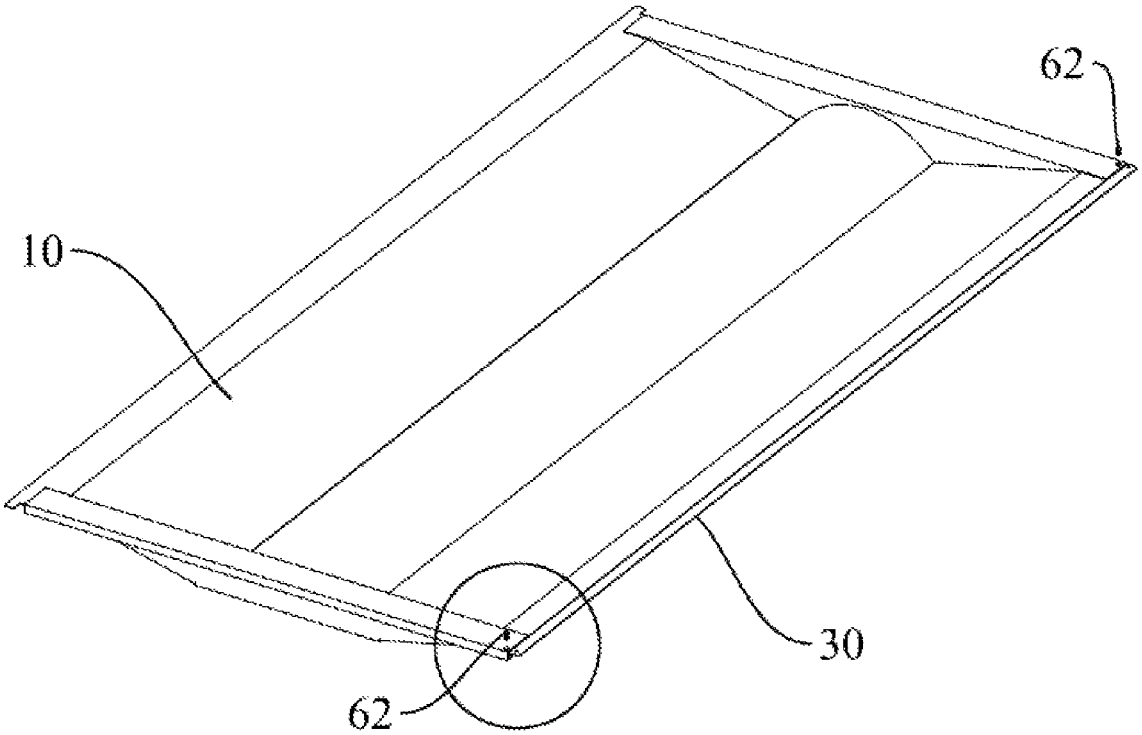
FIG. 23 is a rear view of the recessed replaceable LED office lamp in Embodiment 5 (pin removal state).
Figure 24:
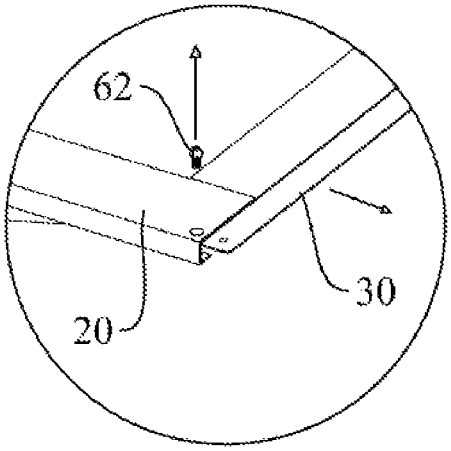
FIG. 24 is a partial enlargement view of FIG. 23.
Figure 25:
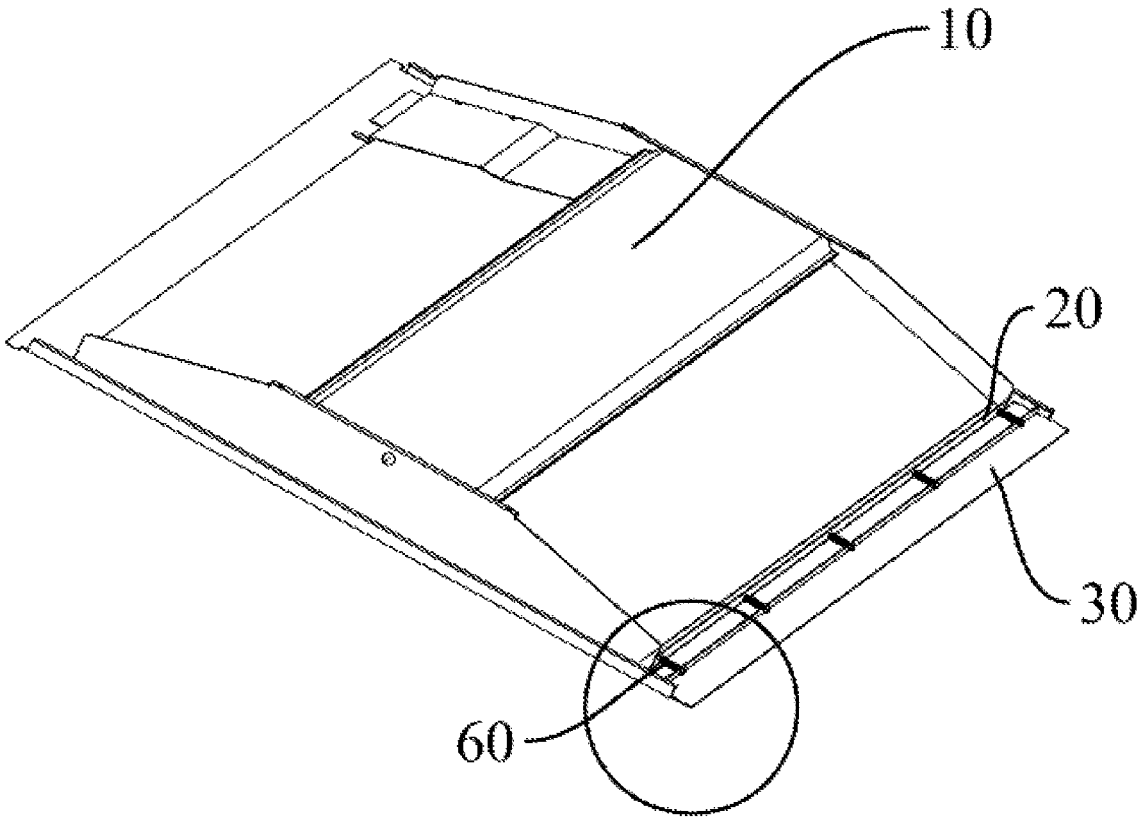
FIG. 25 is a front view of the recessed replaceable LED office lamp in Embodiment 5 (pin removal state).
Figure 26:
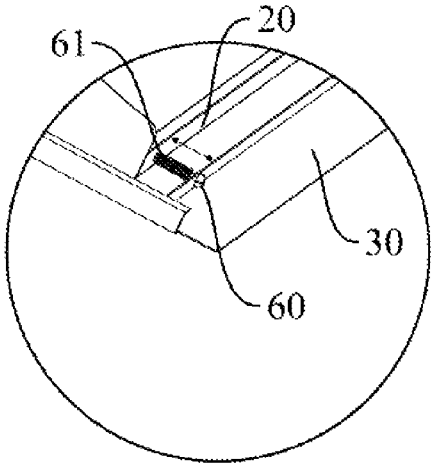
FIG. 26 is a partial enlargement view of FIG. 25.

At least one of the two side edges of bottom plate 20 corresponding to side plate 13 is arranged with a hanging plate 30, which is mounted on the lower side of bottom plate 20. As shown in FIGS. 19 and 20, spring spins 60 are arranged along the horizontal movement direction of hanging plated 30, and both ends of each spring spin 60 are respectively fixed on the side edges of bottom plate 20 and hanging plate 30. The side edge of hanging plate 30 is arranged with vertical upturned edges. One end of spring spin 60 threads through the end of bottom plate 20, and the other end threads through the mounting hole on the side edge of hanging plate 30 for fixing; compression spring 61 is arranged between the side edges of hanging plate 30 and bottom plate 20. As shown in FIGS. 21 and 22, when compression spring 61 is in the compression state, it fixes bottom plate 20 and hanging plate 30 from the bottom of hanging plate 30 via fixing pin 62 from the rear. As shown in FIGS. 23-26, for the removal of fixing pin 62, fixing pin 62 is pulled out while compression spring 61 recovers and elongates. Under the acting force of compression spring 61, hanging plate 30 is pushed to horizontally slide outwards, moving in the elongation direction of a plurality of spring spins 60; finally it is locked by compression spring 61 at the set position relative to bottom plate 20. The locking position is set according to the maximum deformation variable of compression spring 61. Preferably, to achieve balanced horizontal movement of hanging plate 30, spring spins 60 are uniformly arranged on side edges, and a plurality of fixing pins 62 are arranged optionally.

In the mounting process, it is advisable to clamp the fixed end of one side of bottom plate 20 on joist 71, and turn over the other side after wiring to enable hanging plate 30 to rest on joist 71; then remove fixing spins 62, enable hanging plate 30 to horizontally move under the action of compression spring 61, and lock the position after compression spring 61 elongates to complete the mounting work.

Embodiment 6

FIGS. 27-31 illustrate another embodiment of the recessed replaceable LED office lamp in the present invention. Lamp housing 10 comprises top plate 12 and side plates 13 on both sides of the long edge of top plate 12; LED driver mounting rack 14 is arranged in the upper side of side plate 13, and a LED driver is fixedly mounted therein; lampshade 11 is inserted in lamp housing 10 to encircle the LED light source module within the containing space composed of lamp housing 10 and lampshade 11; a reflector is arranged in the lower side of side plate 13 and top plate 12. Both sides of the wide edge of top plate 12 are arranged with an end plate 15 respectively, which seals up the openings composed of top plate 12 and side plates 13. The bottom side of lamp housing 10 contains a bottom plate 20 extending outwards, which is respectively connected with the bottom sides of two side plates 13 and two end plates 15; bottom plate 20 extends towards side plates 13 and end plates 15, and the outer edge thereof is arranged on mounting joist 71 at the time of mounting.

Figure 27:
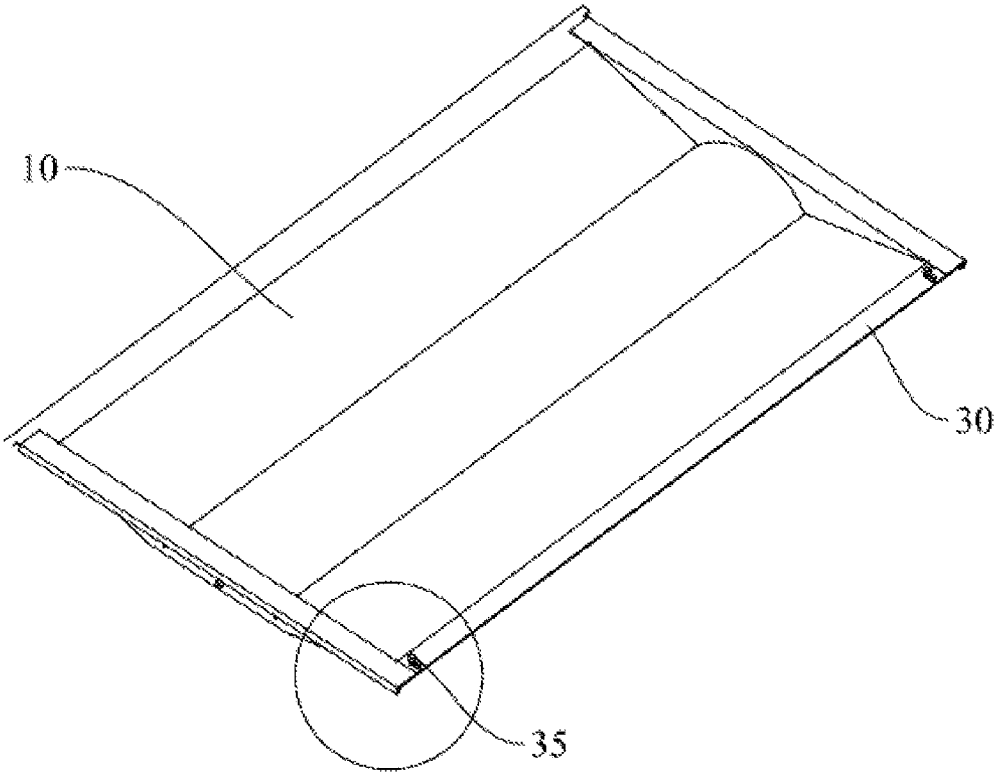
FIG. 27 is a rear structure view of the recessed replaceable LED office lamp in Embodiment 6 of the present invention (withdrawal state of the hanging plate).

At least one of the two side edges of bottom plate 20 corresponding to side plate 13 is arranged with a hanging plate 30, which is mounted on the lower side of bottom plate 20. As shown in FIG. 27 which is a rear view, the back of hanging plate 30 is connected with a rotating fastener 35; the bottom of bottom plate is arranged with a sliding slot 21; the bottom end of rotating fastener 35 is arranged with an end cap 36 fitting the size of sliding slot 21, and end cap 36 is capable of being embedded in sliding slot 21 by a 180° rotation clockwise or counterclockwise to realize locking between hanging plate 30 and bottom plate 20. Rotating fastener 35 is connected with the back of hanging plate 30 by a screw, which moves along sliding slot 21; besides, rotating fastener 35 is movably connected to the screw end. On the one hand, rotating fastener 35 is capable of rotating around the screw; on the other hand, the inner wall depth of rotating fastener 35 is greater than the longitudinal distance between the screw and the rotating fastener (contact portion); the contactless portion forms a movable cavity, enabling rotating fastener 35 to slightly move up and down along the screw.

Preferably, to achieve balanced horizontal movement of hanging plate 30, sliding slots 21 and rotating fasteners 35 are uniformly arranged on the side edges. For example, as shown in FIG. 27, one sliding slot 21 and one rotating fastener 35 are arranged on both ends.

Figure 28:
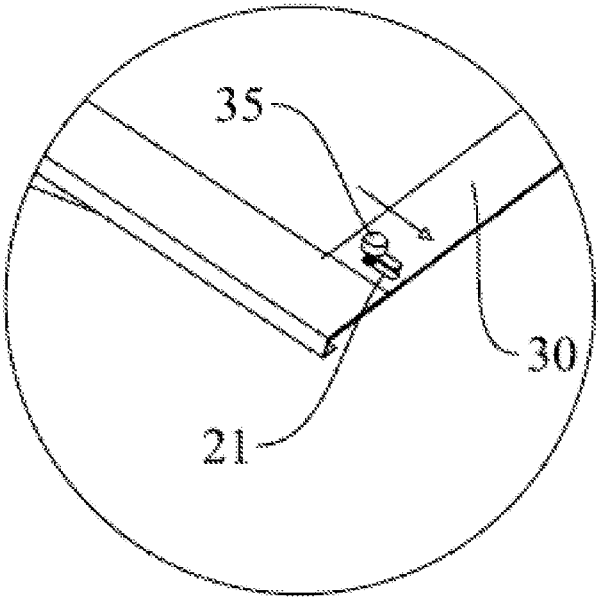
FIG. 28 is a partial enlargement view of FIG. 27.
Figure 29:
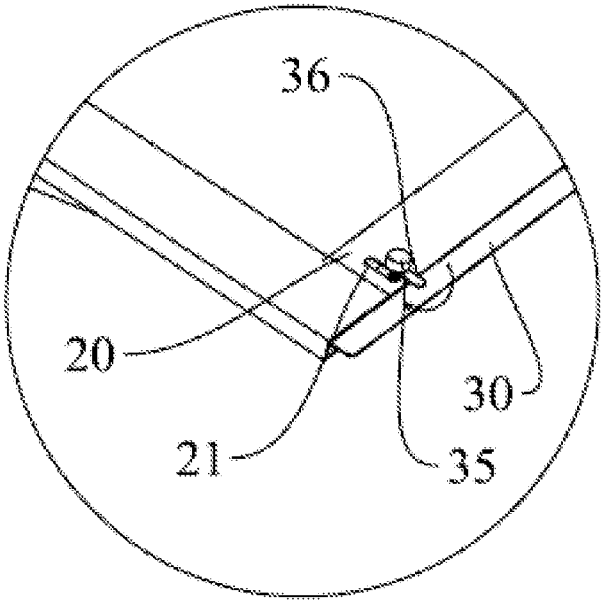
FIG. 29 is a rear view of the hanging plate after horizontal movement in Embodiment 6 (rotating fasteners do not rotate).
Figure 30:
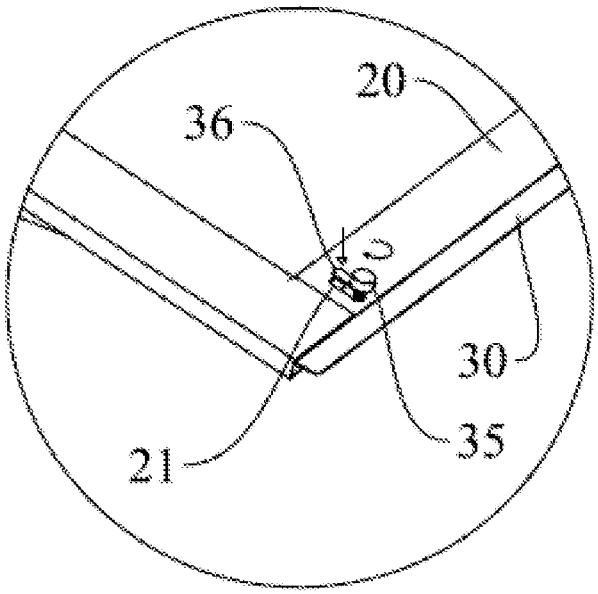
FIG. 30 is a rear view of the hanging plate after horizontal movement in Embodiment 6 (rotating fasteners rotate 180°).
Figure 31:
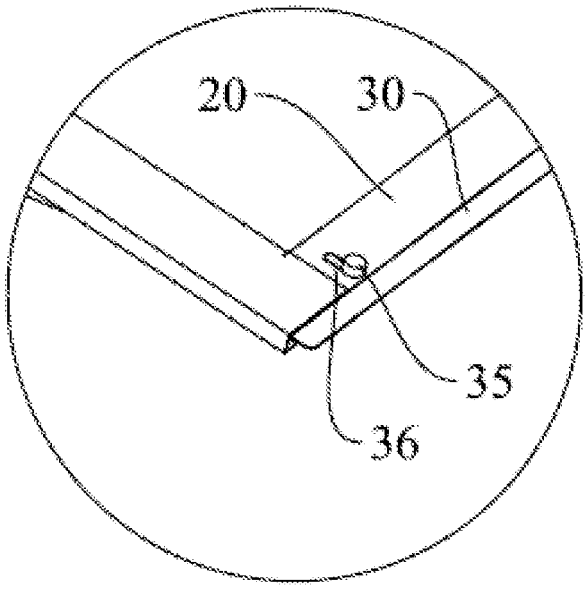
FIG. 31 is a rear view of the hanging plate after horizontal movement in Embodiment 6 (rotating fasteners locked).

In the mounting process, it is advisable to clamp the fixed end of one side of bottom plate 20 on joist 71, and turn over the other side after wiring to enable hanging plate 30 to rest on joist 71; then, as shown in FIG. 28, lift rotating fastener 35 and grasp its top to push hanging plate 30 outwards, enabling hanging plate 30 to horizontally move a distance. As shown in FIG. 29, the screw moves from the inner side to outer side of sliding slot 21. Afterwards, it is feasible to make rotating fastener 35 rotate 180°, enabling the end cap 36 below rotating fastener 35 to fit the inner edge of sliding slot 21, as shown in 30. Then, it is advisable to press down end cap 36, and fasten it into sliding slot 21 to lock the position and complete the mounting work, as shown in FIG. 31.

The aforesaid contents illustrate a plurality of embodiments and operation methods at the time of mounting regarding the recessed replaceable LED office lamp in the present invention. It is observed that the recessed lamp provided in the present invention is easy to use, convenient for mounting and disassembly, capable of quickly completing the mounting work with no need of assembling components with the help of the structures of the old lamp panel like the joist, and has the advantages of firm fixation after mounting and attractive appearance, with wide acceptance.

The preferred embodiments of the present invention are described above in detail. It should be understood that those skilled in the art are capable of making various modifications and changes based on the conception of the present invention, without performing creative labor. Therefore, any technical solutions obtained by those skilled in the art through logic analysis, inference or limited experiments on the basis of the prior art shall fall within the scope of protection defined in the claims.

The invention claimed is:

1. A recessed replaceable LED office lamp, comprising:

a lamp housing;

a lampshade; and a LED light source module being arranged in a lower side of the lamp housing, wherein the lamp housing comprises:

a top plate having first sides that are parallel to each other and second sides that are parallel to each other and perpendicularly connect the first sides of the top plate;

two side plates respectively extending from the first sides of the top plate inclinedly relative to the top plate, each side plate having first sides being parallel with the first sides of the top plate and second sides perpendicularly connecting the first sides of the each side plate, the second sides of the each side plate extending from respective ends of the second sides of the top plate;

end plates respectively arranged to close trapezoidal openings formed by the second sides of the top plate and the corresponding second sides of the two side plates;

a bottom plate formed on and extending outwards from the corresponding first sides of the side plates and a bottom side of each of the two end plates, and an outer edge of the bottom plate being arranged connected to a mounting joist at the time of mounting;

a hanging plate being movably connected to a lower side of at least one of sides of the bottom plate via a plurality of connecting mechanisms;

the hanging plate is horizontally slidable outwardly from sides of the bottom plate in a direction away from the top plate by coordinating with the connecting mechanisms, a locking mechanism is arranged to lock a position of the hanging plate on the bottom plate after horizontal sliding, and the lampshade is inserted in the lamp housing so as to encircle the LED light source module within a containing space composed of the lamp housing and the lampshade.

2. The recessed replaceable LED office lamp as claimed in claim 1, wherein the connecting mechanisms comprise sliding fasteners on the hanging plate, and the bottom plate is arranged with a sliding slot; the sliding fasteners are fixedly connected with the hanging plate and threaded through the sliding slot; each sliding fastener is fastened to an upper end face of the bottom plate through the bottom plate.

3. The recessed replaceable LED office lamp as claimed in claim 2, wherein one side of the hanging plate facing towards the lamp housing is bent or welded into a convex rib, which protrudes downwards from the bottom plate.

4. The recessed replaceable LED office lamp as claimed in claim 2, wherein the edge of the bottom plate is arranged with a vertical wall, which is arranged with a side slot that is parallel to a direction of the sliding slot on the bottom plate in a middle of a side end of the hanging plate; a locking slot from an upper end to the middle of the vertical wall is arranged adjoining the side slot; the side edge of the hanging plate is fixedly connected with a latch, and a rotating shaft is arranged in a middle of the latch; the rotating shaft is embedded in the side slot and capable of sliding along the side slot; a head of the latch is bent into a hook which is capable of being clipped in the locking slot of the vertical wall as rotated so as to realize locking between the hanging plate and the bottom plate.

5. The recessed replaceable LED office lamp as claimed in claim 4, wherein a tail of the latch comprises the handle extending downwards laterally; the latch rotates along the rotating shaft by use of the handle; when the hook is fixed in the locking slot of the vertical wall, the handle clings to the bottom of the bottom plate.

6. The recessed replaceable LED office lamp as claimed in claim 3, wherein ball-catches are arranged on both side ends of the bottom plate, or on the side edges of a front face of the bottom plate, or in the middle of the front face of the bottom plate; an end of the ball-catch is arranged with a press-type spring bead or spring cylinder, which threads through the bottom plate; a center or edge of the hanging plate is arranged with a keyhole corresponding to the spring bead or spring cylinder; during a horizontal movement of the hanging plate, the spring bead or spring cylinder is buckled into the keyhole to realize locking or release between the hanging plate and the bottom plate.

7. The recessed replaceable LED office lamp as claimed in claim 1, wherein the connecting mechanisms comprise spring pins arranged along a direction of a horizontal movement of the hanging plate; both ends of each spring pin are respectively fixed on the side edges of the bottom plate and the hanging plate; a compression spring is arranged between the side edges of the bottom plate and the hanging plate; when the compression spring is in the compressed state, a fixing pin fixes the bottom plate and the hanging plate from a bottom of the hanging plate; when the fixing pin is removed, the compression spring recovers, locking a position of the hanging plate relative to the bottom plate.

8. The recessed replaceable LED office lamp as claimed in claim 1, wherein the connecting mechanisms comprise rotating fasteners on a back side of the hanging plate; the lower side of the bottom plate is arranged with a sliding slot; a rotating fastener is connected with the back side of the hanging plate by a screw which moves along a sliding slot; the rotating fastener is connected to the screw end in a rotatable way; a bottom side of the rotating fastener is arranged with an end cap fitting the size of the sliding slot, and the end cap is capable of being embedded in the sliding slot by a 180° rotation clockwise or counterclockwise to realize locking between the hanging plate and the bottom plate.

9. The recessed replaceable LED office lamp as claimed in claim 1, wherein a reflector is arranged in a lower side of the side plate and the top plate of the lamp housing.

10. The recessed replaceable LED office lamp as claimed in claim 9, wherein a LED driver mounting rack is arranged in an upper side of the side plate of the lamp housing.

* * * * *